US009446300B2

(12) United States Patent
Nordahl et al.

(10) Patent No.: US 9,446,300 B2
(45) Date of Patent: Sep. 20, 2016

(54) GAMING WHEEL

(71) Applicant: Tangiamo AB, Gothenburg (SE)

(72) Inventors: Mats Nordahl, Trangsund (SE); Jimmy Eiterjord, Gothenburg (SE)

(73) Assignee: TANGIAMO AB, Göteborg (SE)

( * ) Notice: Subject to any disclaimer, the term of this patent is extended or adjusted under 35 U.S.C. 154(b) by 402 days.

(21) Appl. No.: 14/136,509

(22) Filed: Dec. 20, 2013

(65) Prior Publication Data

US 2014/0187306 A1 Jul. 3, 2014

Related U.S. Application Data

(63) Continuation of application No. PCT/EP2012/060555, filed on Jun. 5, 2012.

(30) Foreign Application Priority Data

Jun. 21, 2011 (EP) ..... 11170811

(51) Int. Cl.
*A63F 5/00* (2006.01)
*G07F 17/32* (2006.01)
*A63F 9/24* (2006.01)

(52) U.S. Cl.
CPC ..... *A63F 5/00* (2013.01); *A63F 5/007* (2013.01); *G07F 17/3202* (2013.01); *G07F 17/3211* (2013.01); *A63F 2009/2457* (2013.01); *A63F 2009/2458* (2013.01)

(58) Field of Classification Search
USPC ..... 463/17, 20
See application file for complete search history.

(56) References Cited

U.S. PATENT DOCUMENTS

| | | | | |
|---|---|---|---|---|
| 7,762,883 | B2 | 7/2010 | Griswold et al. | |
| 2005/0059477 | A1* | 3/2005 | Baerlocher | G07F 17/3211 463/20 |
| 2005/0059478 | A1* | 3/2005 | Peterson | G07F 17/3211 463/20 |
| 2006/0183532 | A1* | 8/2006 | Jackson | G07F 17/3262 463/20 |
| 2011/0111833 | A1 | 5/2011 | Nordahl et al. | |
| 2014/0018158 | A1* | 1/2014 | Guinn | G07F 17/3267 463/25 |
| 2015/0154823 | A1* | 6/2015 | Barclay | G07F 17/3213 463/20 |

FOREIGN PATENT DOCUMENTS

| | | | |
|---|---|---|---|
| EP | 0914850 | A | 5/1999 |
| EP | 2469489 | A | 6/2012 |
| WO | 2008134802 | A | 11/2008 |

OTHER PUBLICATIONS

PCT International Search Report and Written Opinion dated Jul. 11, 2012 for PCT International Application No. PCT/EP2012/060555, 8 pages.

* cited by examiner

*Primary Examiner* — Pierre E Elisca
(74) *Attorney, Agent, or Firm* — Remarck Law Group PLC

(57) ABSTRACT

The present invention relates to a gaming wheel (100) adapted to be used in a gaming device for playing a game, wherein the gaming wheel (100) comprises a first section (112) having a predetermined number of slots (110) for receiving a gaming element (102) and a second section (106) arranged to provide gaming information for the predetermined number of slots (110) of the first section (112). The second section (106) is arranged such that computer generated gaming information is controllably provided for the predetermined number of slots (110) of the first section (112).

18 Claims, 6 Drawing Sheets

GAMING WHEEL

RELATED APPLICATIONS

This application is a continuation of PCT International Application No. PCT/EP2012/060555, filed Jun. 5, 2012, which claims priority to and all of the advantages of European Patent Application No. 11170811.1, filed Jun. 21, 2011. The disclosure of each of the above applications is incorporated herein by reference in their entirety.

FIELD OF THE INVENTION

The present invention relates to a gaming wheel adapted to be used in a gaming device, and more particularly to a gaming wheel having improved randomness characteristics.

The invention also relates to a gaming system, method and a display element.

BACKGROUND OF THE INVENTION

Roulette and other type of games using a gaming wheel have been played for a long time. When, for example, a game of roulette is to be played, players execute their bet by placing chips or tokens on the betting layout, and then the dealer spins the roulette wheel and puts the ball in motion in the roulette bowl. As the speed of the ball decreases it will fall down from the roulette bowl and into the roulette wheel, where it eventually will come to rest in one of the slots. The outcome of the game is thus executed in a random fashion. Such random fashion is determined by the mechanical parts of the roulette wheel. In order to increase the randomness of the game, the wheel may be provided with ball stops that are intended to interrupt the travel of the ball before coming to rest in one of the slots. The installation of the roulette wheel requires that the system is to be set at perfect level in order to achieve a desired randomness.

However, although the roulette wheel is designed to randomise results, it is known that an experienced roulette dealer can determine a section or a group of numbers in which the roulette ball will finally end up. This is possible since the speed of the roulette wheel and the ball is determined by the dealer (croupier) and he will thus be able to predict a group of numbers, or even the exact number, to win the game. This is possible despite the installation of ball stops. Furthermore, even an experienced player may be able to determine a winning number based on the speed of the ball and the roulette wheel.

A solution to overcome these problems is provided in U.S. Pat. No. 7,762,883, disclosing a motorized random number based roulette wheel. When a game of roulette is played, a number generator is arranged to provide a random number to a processor. Thereafter, the ball decreases in speed and enter one of the slots which is noticed by the processor. The rotation of the wheel is then decreased and controlled by means of a motor such that the number provided to the processor by the number generator corresponds to the slot where the ball has entered, i.e. the winning number is the number generated by the random number generator.

The solution in U.S. Pat. No. 7,762,883 provides for a roulette wheel which is independent of any mechanical deficiencies in order to achieve randomness of the game. Furthermore, the game provides such randomness that an experienced dealer/player may not be able to affect/predict the outcome of the game.

However, despite the fact that U.S. Pat. No. 7,762,883 provides a roulette wheel having improved randomness characteristics, there may still be a further need of a roulette wheel not only having improved randomness characteristics, but providing a more realistic roulette gaming experience for the players. Furthermore, there may also be a need of a roulette wheel that is more cost beneficial for the manufacturer of the gaming apparatus.

SUMMARY OF THE INVENTION

According to an aspect of the invention, the above may at least partly be met by a gaming wheel adapted to be used in a gaming device for playing a game, wherein the gaming wheel comprises a first section having a predetermined number of slots for receiving a gaming element, a second section arranged to provide gaming information for the predetermined number of slots of the first section, wherein the second section is arranged such that computer generated gaming information is controllably provided for the predetermined number of slots of the first section.

The invention is based on the understanding that an improved randomness characteristic of the gaming wheel will provide a gaming device which may be beneficial for both the players as well as for the e.g. establishment providing the gaming device. Advantages with the invention include, for example, that gaming information provided for the predetermined number of slots of the first section is computer generated, thereby controlled to provide gaming information for the slots and provide randomness characteristic of the wheel, despite any mechanical deficiencies of the wheel. The gaming information is thus provided to the second section by means of a computer and may therefore be altered, e.g. continuously, during the game. Therefore, the computer generated gaming information of the second section may reduce the possibility to predict the outcome of the game, both for the players participating in the game, as well as for the dealer of the game. Also, providing computer generated gaming information may reduce the number of mechanical features for improving the randomness characteristics of the game.

It should be noted that the inventive concept allows for a uniform distribution of the computer generated gaming information in relation to each of the slots of the first section. That is, at a specific time it may according to the invention be possible to provide an in essence absolute random distribution of the computer generated gaming information in relation to each of the slots of the first section, while (when the gaming wheel eventually stops) it will actually be the gaming element that determines the outcome of the game.

Furthermore, as the gaming information of the second section may be altered during a game, the gaming wheel may be well suited for live broadcasting, such that players may be able to participate at a remote distance from the gaming device. For example, a camera may visually acquire the gaming activity at the gaming device and provide the gaming activity to the player participating at a remote distance. The player participating at a remote distance may follow the game and place his bet as if he was participating at the gaming device. The alteration of the gaming information thereby prevents the player participating at a remote distance from predicting the outcome of the game. This may therefore allow a large plurality of players to participate in the game simultaneously.

In one embodiment of the present invention, the second section comprises at least one display element configured to display the computer generated gaming information. The display element may display the computer generated gaming information for the predetermined number of slots. Furthermore, the computer generated gaming information may be controlled such that the display element provides gaming information for the predetermined number of slots. Hereby, each slot may be provided with updated gaming information when a new game is to be played, thus compensating for any mechanical deficiencies of the gaming wheel that might make the outcome of the game predictable. The display element may, for example, be an OLED-device, LCD-device, etc. Moreover, the gaming wheel may be a roulette wheel and the gaming element may be a ball.

Furthermore, the computer generated gaming information may be provided to a portion of the second section corresponding to a slot of the first section. Hereby, each slot of the first section may be arranged to correspond to a portion of the second section which may be controllably updated during at least a part of the game, thus providing an improved randomness characteristic. For example, at a first period of the game, the wheel is rotating and each slot corresponds to a specific computer generated gaming information. Thereafter, when for example no more bets are allowed, the wheel continues to rotate but the computer generated gaming information travels slowly in the opposite direction compared to the rotating direction. Hereby, each slot will hence correspond to the computer generated gaming information of its adjacent slot. The travel of the computer generated gaming information may, in this example, be executed in a uniform manner and in such low intervals that the players may not notice it. An advantage of this is that e.g. the ball in regards to a game of roulette will finally enter one of the slots in a random fashion, still having the participants believing that each slot continuously corresponded to the same computer generated gaming information as in the beginning of the game. According to another example, at a certain time during the game for example being a game of roulette, when the roulette ball is spinning around the roulette bowl and players continuously place their bet, each slot corresponds to certain computer generated gaming information via the corresponding portion of the second section. Thereafter, when no more bets are allowed, the computer generated gaming information may change, such that each slot may correspond to updated computer generated gaming information different from the previously corresponding gaming information of the slot. Alternatively, the computer generated gaming information of the second section may vary in such a way that the players/dealer perceive the gaming information to "rotate" on the second section, in the opposite direction of the first section, in a varying speed. This may further reduce the predictability of the outcome of the game and thereby also provide a randomness of the game, despite any mechanical deficiencies of the roulette wheel. The portion of the second section may, furthermore, be provided with random computer generated gaming information. An advantage is that the random characteristic of the roulette wheel may be further improved as the updated computer generated gaming information for each of the slots may be varied differently for each game played.

According to another embodiment of the present invention, the second section may comprise an equal predetermined number of portions as the predetermined number of slots of the first section. Hereby, each slot may always correspond to a specific portion of the second section. Furthermore, if the second section comprises a display element as described above, each portion corresponding to a slot of the first section may be an individual display element.

Furthermore, the computer generated gaming information may comprise at least one symbol, wherein the at least one symbol may be provided adjacently to at least one slot of the first section. The symbols may, for example, be integers in the range of 0 to 37 if it is a French/European style roulette wheel, or 0 to 37 with an additional double-zero if it is an American style roulette wheel. However, the wheel may be expanded such that the symbols correspond to the symbols of the cards in a typical deck of cards. Further symbol alternatives may be those of a typical slot machine such as integers, cherry symbols, BAR-signs, or the like.

Furthermore, more than one symbol may be provided for each slot of the gaming wheel. This provides a game with multiple winning alternatives. For example, if one player bets on a certain gaming information and another player bet on another gaming information, both players may have the winning outcome of the game. An advantage is that the probability of winning a game increases and thereby attracts more players to participate.

Still further, the gaming wheel may preferably be provided as a component of a gaming system, wherein the gaming system also comprises a gaming table having a gaming layout arranged to receive bets executed by at least one player. Hereby, a system may be provided that allow players to plays their bet during a betting period. By providing the above mentioned gaming wheel, with its effects and features as described above, may further provide a system with improved randomness characteristic despite any mechanical deficiencies of the gaming wheel. Furthermore, the gaming system may also comprise a gaming layout comprising an electronic multi-player touch screen. The electronic multi-player touch screen is further disclosed in e.g. EP10196546 by the applicant, which is incorporated by reference in its entirety. The bets may be executed by pressing the desired number on the gaming layout, which may reduce the need of gaming chips and/or coins. Furthermore, a multi-player touch screen may also provide a system where bets and payout can be carried out in a fast and efficient manner.

Additionally, by display concept of the adaptable gaming wheel of the invention allows for a flexible selection of which types of games to be played and the specific layout of that game. For example, a generic gaming platform may be provided comprising the inventive gaming wheel and the layout and type of game may be customized for the specific establishment using the gaming platform. If combining the gaming wheel with the electronic multi-player touch screen, the flexibility may be valid for both components and may provide for an additional flexibility in regards to the selection of game and gaming layout.

According to an embodiment, the system may further comprise a camera arranged to visually acquire at least gaming information from the gaming wheel. This may be advantageous if the system is used for, as described above, having players participating at a remote distance from the gaming table. The camera may thus acquire gaming information not only from the gaming wheel, but also from the gaming layout, such that players may follow and participate in the game from a remote distance of the physical game site. The gaming system may thus further comprise at least one remote gaming device configured to allow interaction of a remote user. This may enable a player to participate at a remote distance from the physical game site. The remote player may thus acquire gaming information from the camera and plays his bet(s) by use of the remote gaming device. The remote gaming device may, for example, be one of a mobile phone, a PDA, a laptop, or a tablet computer.

Furthermore, the gaming system may also comprise a control unit arranged to control bets executed on the multi-player touch screen, and wherein the control unit is further arranged to provide computer generated gaming information for the predetermined number of slots of the first section of the gaming wheel. Hereby, the bets may be executed in a controlled manner and the gaming information provided for the predetermined number of slots may be generated in a random fashion executed by the control unit.

According to a further aspect of the invention, the above mentioned may at least partly be achieved through a method for operating a game having a gaming wheel, wherein the gaming wheel comprises a first section having a predetermined number of slots for receiving a gaming element, a second section arranged to provide computer generated gaming information for the predetermined number of slots of the first section, wherein the method comprises the steps of: spinning the gaming wheel during a first period of the game, determining at a second period of the game that no more bets are allowed, receiving the gaming element into one of the slots at a third period of the game, wherein the computer generated gaming information is altered during at least one of the first, second or third periods of the game. Furthermore, at least one display element may be configured to display the computer generated gaming information. Hereby, each slot may be provided with updated computer generated gaming information when a new game is to be played, or during one of the periods of the game.

According to a still further aspect of the present invention, there is provided a display element for use in a gaming wheel, wherein the gaming wheel comprises a first section having a predetermined number of slots for receiving a gaming element, a second section arranged to provide gaming information for the predetermined number of slots of the first section, wherein the display element is arranged to be integrated in the second section and to controllably provide computer generated gaming information. Furthermore, the display element may be releasably arranged to the second section of the gaming wheel. An advantage is that the display element may be released from the second section of the gaming wheel, and thereby be replaced if, for example, the display element will be out of order or in any other way not functioning properly. Still further, another advantage of a releasably arranged display element is that a regular gaming wheel, having standing numbers corresponding to each slot, may be upgraded by replacing the standing numbers with the releasably arranged display elements, in order to further improve the randomness characteristics of the gaming wheel.

Other objectives, features, and advantages of the present invention will appear from the following detailed disclosure, from the attached dependent claims as well as from the drawings.

BRIEF DESCRIPTION OF THE DRAWINGS

These and other aspects of the present invention will now be described in more detail, with reference to the appended drawings showing at least one example embodiment of the invention, wherein.

DETAILED DESCRIPTION OF PREFERRED EMBODIMENTS

Figure 1:
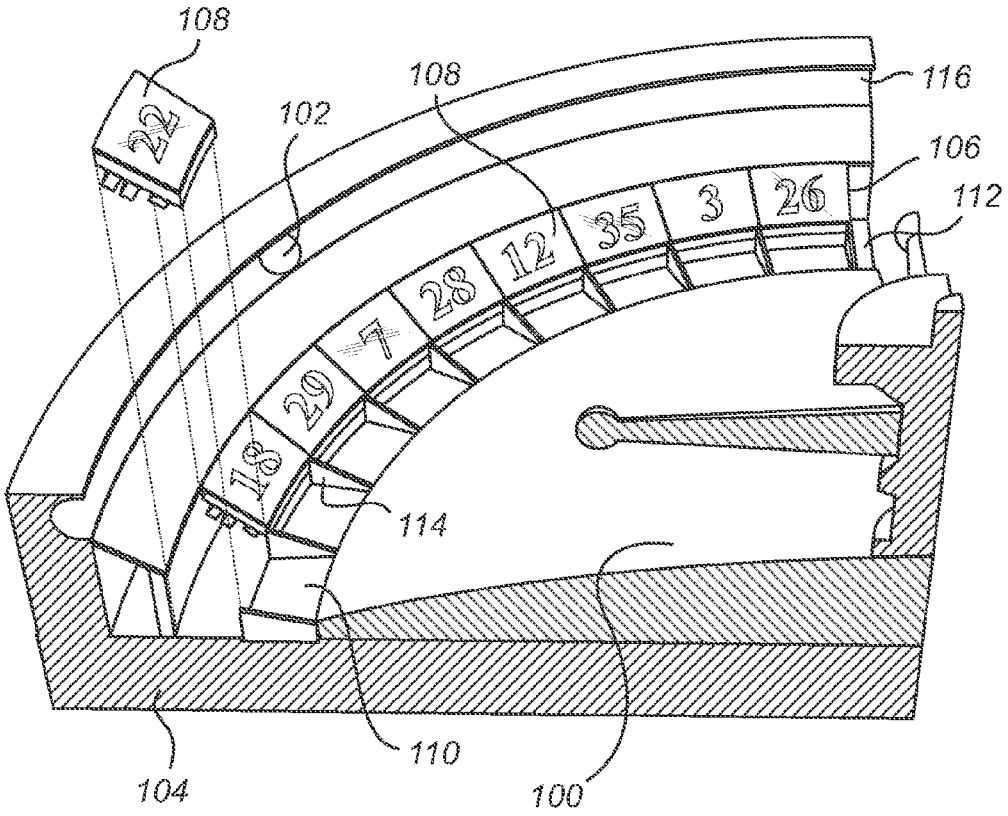
FIG. 1 schematically illustrates a part of a roulette wheel and a roulette bowl according to an embodiment of the present invention, FIG. 2 schematically illustrates the roulette wheel of FIG. 1 connected to a computer device, FIGS. 3*a*-3*c* schematically illustrate a sequence where a display element of FIG. 1 switches from one integer to another.
Figure 2:
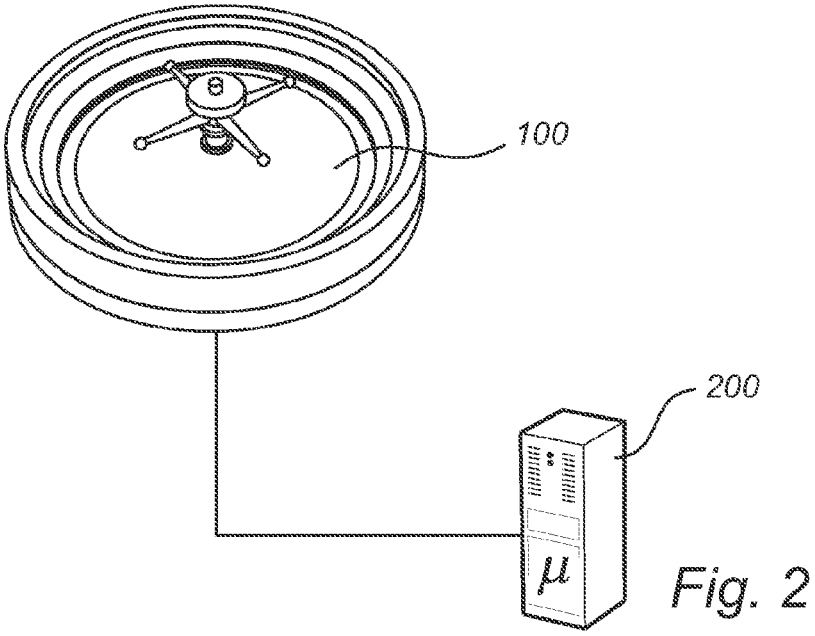

The present invention will now be described more fully hereinafter with reference to the accompanying drawings, in which currently preferred embodiments of the invention are shown. The invention will hereinafter mainly be focused on a roulette wheel, which is illustrated in FIGS. 1-2. The invention may, however, be embodied in many different forms, such as a wheel of fortune, illustrated in FIG. 9. The invention should therefore not be construed as limited to the embodiments set forth herein; rather, these embodiments are provided for thoroughness and completeness, and fully convey the scope of the invention to the skilled addressee. Like reference characters refer to like elements throughout.

In the following description, the present invention is described with reference to a gaming wheel 100 for playing a game. A number of players participate in the game and a dealer may control the game by spinning the gaming wheel 100 as well as controlling the betting activity at the gaming table. It should be noted that the following will not be focusing on the table layout or the rules of the game, which is assumed to be fully understood by the skilled addressee.

FIG. 1 illustrates a part of a gaming wheel, here illustrated by a roulette wheel 100 situated within a roulette bowl 104. The roulette wheel 100 is rotatably mounted within the roulette bowl 104 such that the roulette wheel 100 is arrange to spin around its geometric axis and the roulette bowl 104 is arranged to be in connection to, for example, a roulette table. In the roulette wheel 100, an outer ring 106 is arranged to contain display elements 108 and in registration with each display element 108 is a receiving slot 110 in a separator ring 112, wherein the receiving slots 110 are separated by radially disposed separators 114. The display elements 108 may, for example, be arranged to be integrated in the roulette wheel 100. Still further, as is illustrated in FIG. 1, the display element 108 may also be configured to be releasably arranged to the roulette wheel 100. Hereby, the display elements 108 may be replaced if they, for example, have become out of order. A roulette ball 102 is illustrated circulating along the periphery 116 of the roulette bowl 104, and the roulette wheel 100 is rotating around its central geometric axis. When the roulette ball 102 is decreasing in speed, it will fall from the periphery 116 of the roulette bowl 104 and down into the roulette wheel 100, where it eventually will come to rest in one of the slots 110 of the roulette wheel 100.

The display elements 108 are arranged to provide gaming information for the slots 110 of the roulette wheel 100, generated by a computer 200, as illustrated in FIG. 2. In the following, the gaming information will mainly be described by numbers provided by the display elements 108. However, as described above, also other types of gaming information may be provided by the display elements 108, for example, different types of symbols 500. This will be further described in more detail below in relation to FIG. 5.

The numbers of each display 108 may, by use of the computer 200, be varied such that each slot 110 may correspond to different numbers during the game, or between different games played. For example, at the beginning of a game, when the roulette ball 102 spins around the periphery 116 of the roulette bowl 104 as illustrated in FIG. 1, the players continuously place their bet on a number or colour that they believe will be the winning outcome of the game. Each slot 110 corresponds to a specific number and colour, typically red, green or black, during the period of betting. Eventually, as the roulette ball 102 is continuously decreasing in speed and will soon fall down into the roulette wheel 100, the dealer decides that no more bets are allowed. Thereafter, the display elements 108 change number and colour, such that a specific slot 110 corresponds to a different number compared to when bets were executed by the players. The ball 102 will then fall down into one of the slots 110 and the corresponding number provided by the display element 108 for that slot 110 is the winning number of the game. Hereby, the computer 200 generates a random sequence for the roulette wheel 100. The computer 200 may further be arranged to provide a secure wired/wireless communication to the roulette wheel, which may yet further provide a roulette wheel 100 that may be independent of any mechanical deficiencies in order to achieve a desired randomness of the game.

In a further embodiment, the computer 200 may be arranged to alter the number of the displays 108 during the period when bets are executed by the players. Hereby, each slot 110 is continuously provided with an updated number within a predetermined interval, and in the mean time the players may continuously place their bets as described above. When no more bets are allowed, each display 108 is provided with a number on its corresponding display element 108, i.e. the alteration of numbering of the display 108 is finished, and the roulette ball 102 decrease in speed and enters one of the slots 110, providing the winning outcome of the game.

In yet another embodiment, the computer 200 may be arranged such that each slot 110 corresponds to a number on its corresponding display element 108. When no more bets are allowed, the computer 200 puts out the display elements 108 for a predetermined period, i.e. the display elements 108 do not correspond to any number during that period. The display elements 108 are turned on after the predetermined period and each display element 108 may thereafter correspond to either the same number as before the display elements 108 were put out or to an updated number. Preferably, and to increase the randomness of the game, each display 108 may correspond to an updated number compared to before the display elements 108 were put out.

Figures 3A, 3B, 3C:
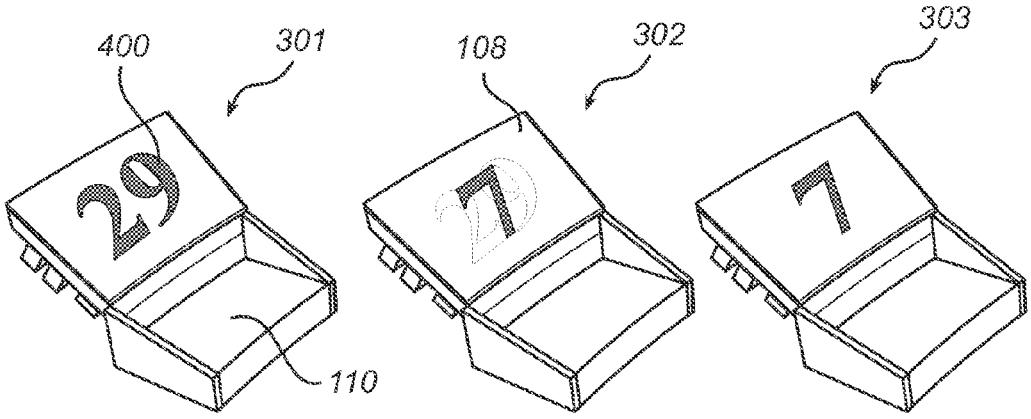

The alteration of gaming information for the display element is in more detail illustrated in FIGS. 3*a*-3*c*. During a first period 301 of the game, for example before "no more bets", a slot 110 corresponds to a specific number, here illustrated in FIG. 3*a* by the number 29. Thereafter, during a second period 302 of the game, the computer is arranged to switch numbers for each display 108, which is illustrated in FIG. 3*b* showing the transformation of the display 108 from number 29 to number 7. Finally, during a third period 303 of the game, the slot 110 is provided with number 7 in its corresponding display element 108 as is illustrated in FIG. 3*c*. The slot 110 may then correspond to number 7 until the game is finished or may go through the procedure of FIGS. 3*a*-3*c* again, in order to be updated with a new number.

Figure 4:
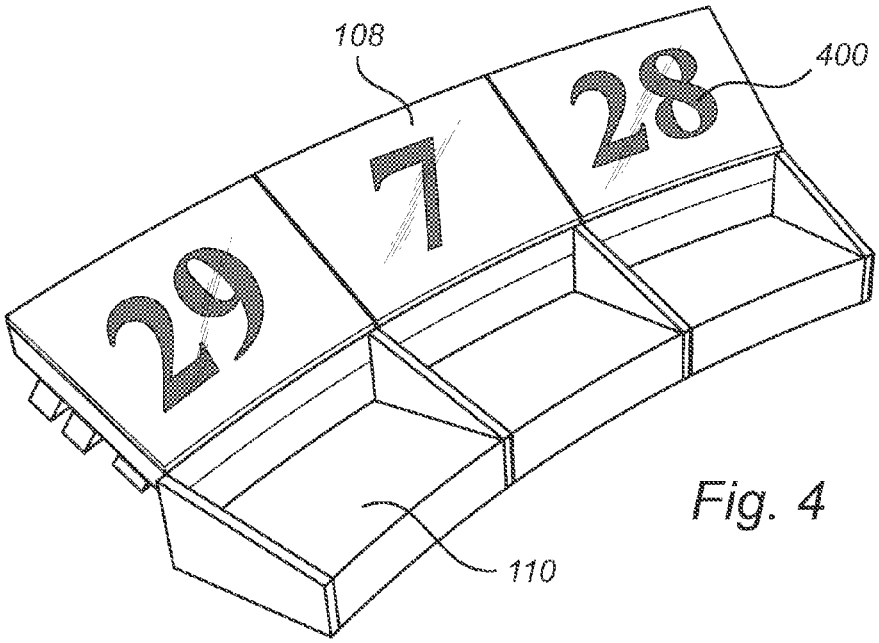
FIG. 4 schematically illustrates an embodiment of the display elements, wherein each display element is provided with an integer, FIG. 5 schematically illustrates an embodiment of the display elements, wherein each display element is provided with a symbol.
Figure 5:
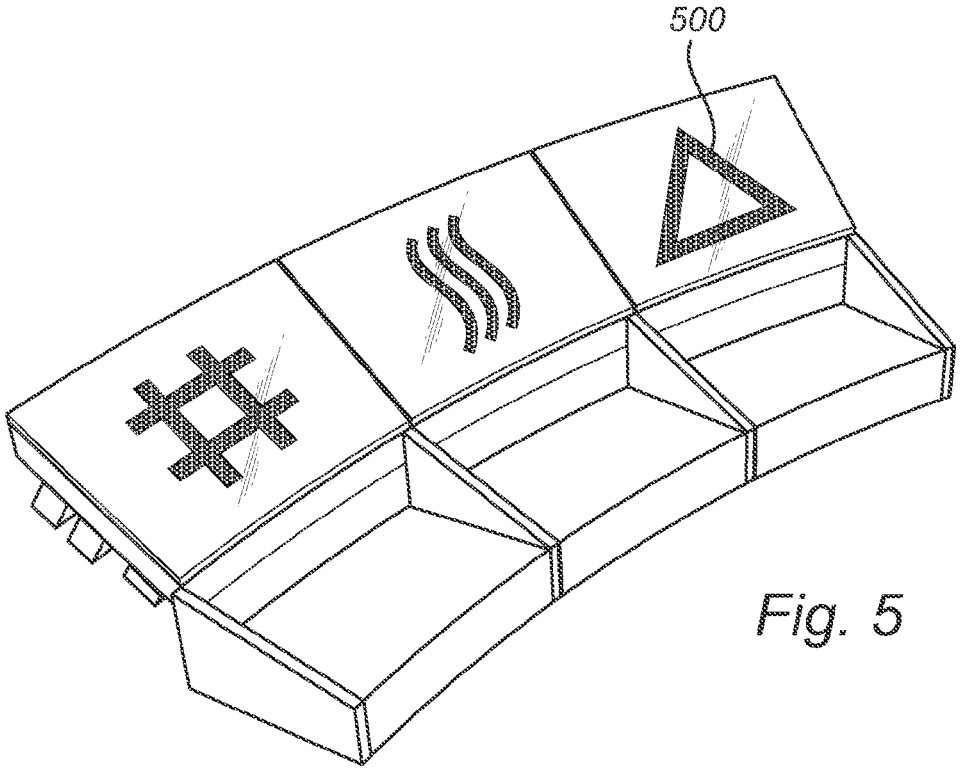
Figure 6:
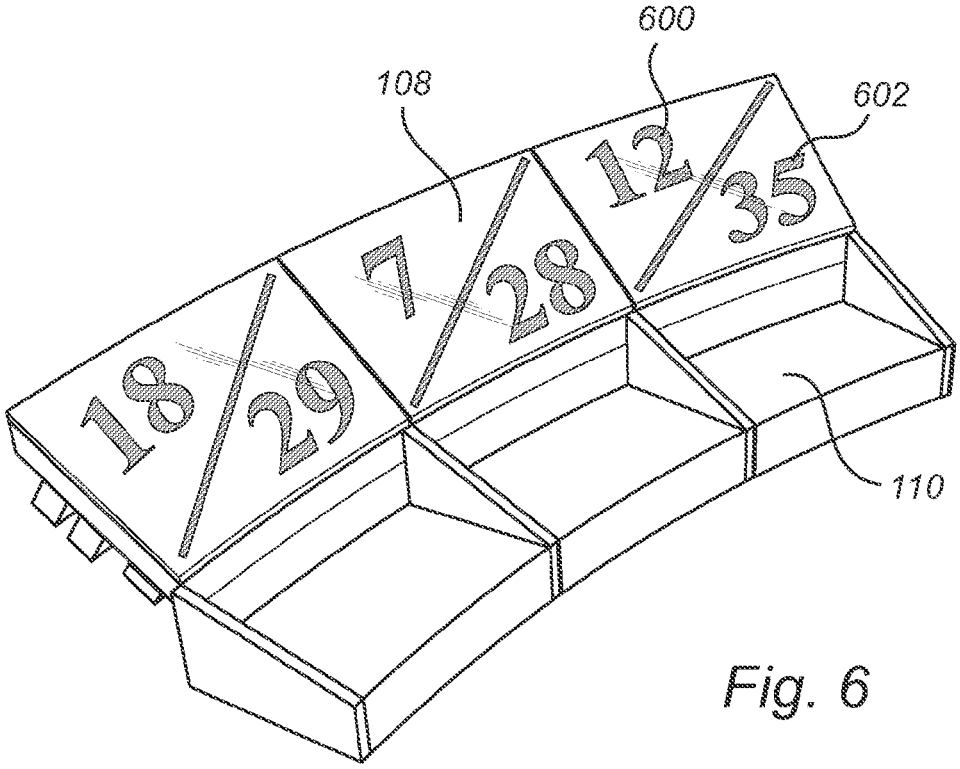
FIG. 6 schematically illustrates an embodiment of the display elements, wherein each display element is provided with two integers.

Now referring to FIGS. 4-FIG. 6, illustrating various embodiments of the gaming information provided by the display elements. According to FIG. 4 the display elements 108 may provide integers 400 illustrating one corresponding integer 400 for each one of the slots 110 of the roulette wheel 100. If the roulette wheel 100 is a French/European-style roulette wheel, there may be 38 displays 108 having the integers 400 from 0 to 37, or if it is a US-style roulette wheel there may be 39 displays 108 having the integers from 0 to 37 with an additional double-zero. Each one of the integers 400 may also correspond to a specific colour, such as, for example, red, green or black.

Furthermore, each display 108 may in another embodiment be provided with a specific symbol 500 as is illustrated in FIG. 5. The symbols 500 may, for example, be the letters in the Greek alphabet or anyone of a Chinese character, etc. The symbols 500 may, in the configuration of FIG. 5, preferably correspond to a similar symbol 500 on the table layout (not illustrated).

When the game of roulette is played, the integers 400 or symbols 500 may change between each of the displays 108 in a random fashion as described above with reference to FIGS. 3*a*-3*c*.

In a further embodiment, each slot 110 may be provided with more than one number to bet on, as illustrated in FIG. 6. For example, two integers 600, 602 may be provided for each slot 110 in the display element 108, such that two numbers will be the winning outcome of the game. This is of course also valid for a roulette wheel 100 having the symbols 500 illustrated in FIG. 5, such that two symbols are provided for each slot 110. For example, when a game of roulette is to be played, two integers 600, 602 or symbols correspond to each other and to a slot 110 of the roulette wheel 100. When the roulette wheel 100 is spinning and the ball 102 is circulating around the periphery 116 of the bowl 104, the computer 200 may alter the integers 600, 602 or symbols in a random fashion between the different displays 108, as described above in relation to FIG. 3*a*-3*c*. When no more bets are allowed by the players, the alteration may be ended and each slot 110 corresponds to two integers 600, 602 or symbols. Thereafter, the ball 102 enters one of the slots 110, providing two winning outcomes of the game. However, the game may further be configured such that the random alteration of integers or symbols is executed after no more bets are allowed, as also described above, such that the combination of integers or symbols of the winning outcome of the game is different compared to what the players expected when placing their bets.

Furthermore, it should be noted that each slot 110 may just as well be provided with two corresponding displays 108 for each slot 110 instead of one display 108 illustrating two integers 600, 602 or symbols as described above in relation to FIG. 6. Also, the invention is not limited to a roulette wheel 100 having one display element 108 for each slot 110, but may just as well be provided with one display circumferentially arranged to provide computer generated gaming information for the slots. For example, one display may provide several numbers or symbols such that each slot corresponds to one of these numbers/symbols.

Figure 7:
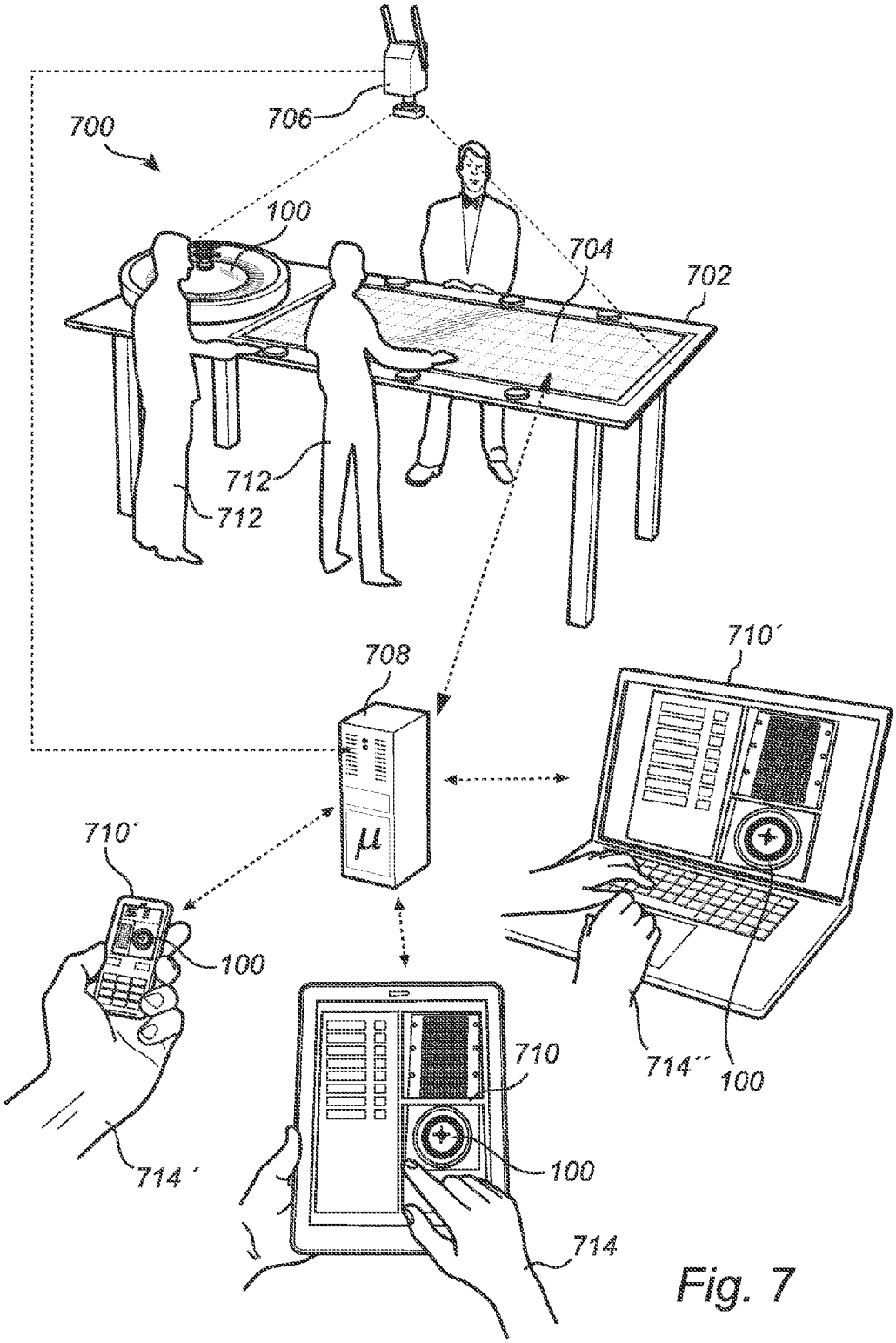
FIG. 7 schematically illustrates a gaming system with a roulette wheel having one of the display elements in FIGS. 1 to 6, FIG. 8 provides a flowchart of an embodiment of the method for operating a game of roulette, and FIG. 9 schematically illustrates a wheel of fortune according to an embodiment of the present invention.
Figure 8:
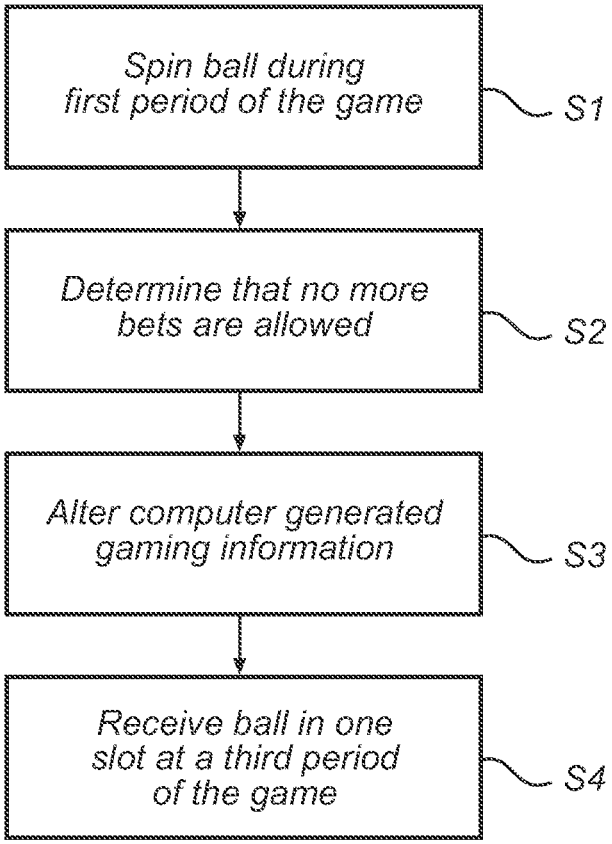

According to the above describe roulette wheel 100 having the randomness characteristics, such a roulette wheel 100 may be well suited as a component in a gaming system 700 for participating at a remote distance from the physical game site, as illustrated in FIG. 7. The gaming system 700 further comprises a roulette table 702 having a roulette layout 704, where the roulette layout 704 in the illustrated embodiment is an electronic multi-player touch screen. Still further, the system 700 comprises a camera 706, a control unit 708 and a number of remote gaming devices 710, 710', 710". The camera 706 is arranged to visually acquire gaming information from the roulette layout 704 and the roulette wheel 100, and the control unit 708, which may preferably be a computer 200 or a server, is arranged to control the bets executed on the electronic multi-player touch screen and also to provide the roulette wheel 100 with computer generated gaming information.

As the roulette wheel 100 has, as described above, an improved randomness characteristic for receiving a ball 102, players participating at a remote distance with a remote gaming device 710, 710', 710" may not be able to predict, by for example use of a computer 200, the outcome of the game. Therefore, the remote players may be provided with gaming information in real time acquired by the camera 706. The remote players may place their bet in accordance with the players participating at the physical game site. The bets executed by the remote players are controlled by the control unit 708 and distributed on the electronic multi-player touch screen.

It should be noted that the gaming system 700 described in relation to FIG. 7 is not limited to a gaming layout 704 having an electronic multi-player touch screen; the system 700 is just as applicable with a regular generic table layout. In such a case, the bets from the remote players may be received and handled by the dealer of the game.

Figure 9:
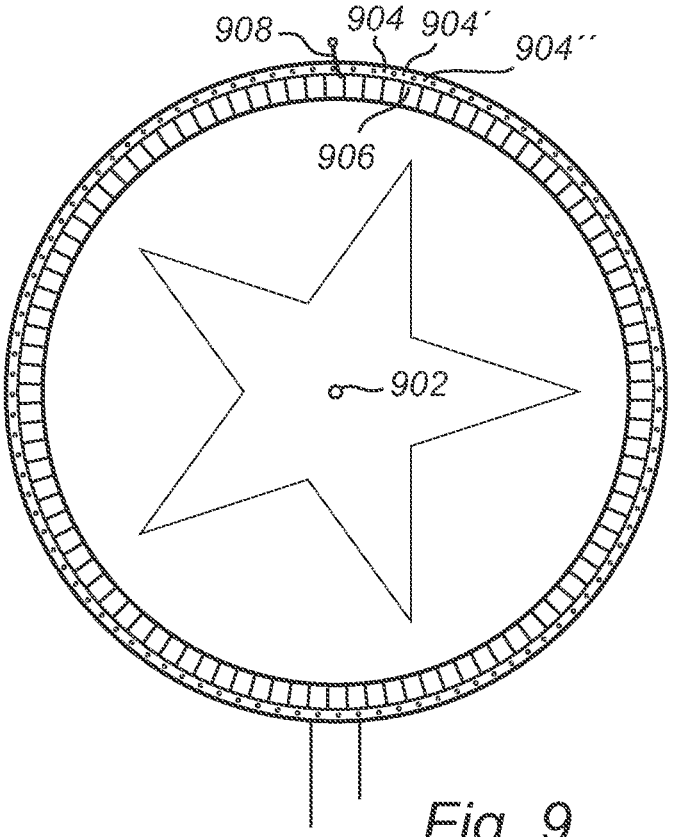

Now referring to FIG. 9 which illustrates another embodiment of the gaming wheel, here illustrated as a wheel of fortune according to an embodiment of the present invention. As can be seen, the wheel of fortune is rotatably mounted at its centre 902, which allows it to spin around a centre axis (not shown here). At the periphery of the wheel there is provided a number of slots 904, 904', 904" as well as a number of display elements 906 and a gaming element 908. The gaming element 908 is in the illustrated embodiment a pin or a stick, etc. arranged to provide a winning outcome of the game played. The display elements 906 may have the same characteristics as the above described display elements 108 in relation to FIG. 1 and will therefore not be described in further detail. In the illustrated embodiment of FIG. 9, each display element 906 corresponds to a number of slots 904, 904', 904" for receiving the pin. However, the skilled addressee realise that the invention is just as applicable with one slot 904 for each display 906.

Other features and aspects of the embodiment illustrated in FIG. 9 are similar to those described above in relation to FIGS. 1-8.

In the claims, the word "comprises" does not exclude other elements or steps, and the indefinite article "a" or "an" does not exclude a plurality. A single computer or other unit may fulfil the functions of several items recited in the claims. The mere fact that certain measures are recited in mutually different dependent claims does not indicate that a combination of these measured cannot be used to advantage.

The invention has mainly been described above with reference to a few embodiments. However, as is readily appreciated by the skilled addressee, other embodiments than the ones disclosed above are equally possible within the scope of the invention, as defined by the appended patent claims. For example, the roulette wheel may just as well be an automatic or electronic roulette wheel, where a dealer is not controlling the game. In such an example, the roulette ball may circulate in the roulette bowl by means of compressed air ejecting the ball into the bowl. Furthermore, the computer generated gaming information for each slot may just as well be provided by a projector arranged to project the computer generated gaming information adjacent the slots.

What is claimed is:

1. A gaming wheel adapted to be used in a gaming device for playing a game, wherein the gaming wheel is adapted to rotate during a gaming operation of the gaming device, and wherein the gaming wheel comprises:

a first section having a predetermined number of slots for receiving a physical gaming element;

a second section arranged to provide gaming information for the predetermined number of slots of the first section, the second section being arranged such that computer generated gaming information is controllably provided for the predetermined number of slots of the first section, and comprising at least one display element configured to display the computer generated gaming information, wherein the computer generated gaming information provided at the at least one display element of the second section is continuously updated during at least a portion of the gaming operation.

2. The gaming wheel according to claim 1, wherein the computer generated gaming information is updated based on a status of the gaming operation.

3. The gaming wheel according to claim 1, wherein the computer generated gaming information is updated based on the rotation of the gaming wheel.

4. The gaming wheel according to claim 1, wherein the gaming wheel is a roulette wheel and the computer generated gaming information is updated based on the position of a roulette ball.

5. The gaming wheel according to claim 1, wherein the gaming wheel is connected to a control unit of a gaming system and the control unit is configured to provide the gaming wheel with the computer generated gaming information.

6. The gaming wheel according to claim 5, wherein the gaming wheel is a roulette wheel.

7. The gaming wheel according to claim 1, wherein the computer generated gaming information is provided to a portion of the second section corresponding to a slot of the first section.

8. The gaming wheel according to claim 1, wherein the second section comprises an equal predetermined number of portions as the predetermined number of slots of the first section.

9. The gaming wheel according to claim 1, wherein the computer generated gaming information comprises at least one symbol, the at least one symbol being provided adjacently to at least one slot of the first section.

10. A gaming system comprising:

a gaming table having a gaming layout arranged to receive bets executed by at least one player, and a gaming wheel according to claim 1.

11. The gaming system according to claim 10, wherein the gaming layout comprises an electronic multi-player touch screen.

12. The gaming system according to claim 10, further comprising a camera arranged to visually acquire at least gaming information from the gaming wheel.

13. The gaming system according to claim 10, further comprising at least one remote gaming device configured to allow interaction of a remote user.

14. The gaming system according to claim 10, further comprising a control unit arranged to control the bets executed on the multi-player touch screen, and wherein the control unit is further arranged to provide computer generated gaming information for the predetermined number of slots of the first section of the gaming wheel.

15. A gaming device for playing a game, comprising:

a gaming wheel adapted to rotate during a gaming operation of the gaming device, the gaming wheel comprising:

a first section having a predetermined number of slots for receiving a physical gaming element, the physical gaming element comprising at least one of a pin, a stick, and a ball, and a second section arranged to provide gaming information for the predetermined number of slots of the first section, the second section being arranged such that computer generated gaming information is controllably provided for the predetermined number of slots of the first section, and comprising at least one display element configured to display the computer generated gaming information, wherein the computer generated gaming information provided at the at least one display element of the second section is continuously updated during at least a portion of the gaming operation.

16. The gaming device according to claim 15, wherein the computer generated gaming information is updated based on the rotation of the gaming wheel.

17. The gaming device according to claim 15, wherein the gaming wheel is a roulette wheel and the computer generated gaming information is updated based on the position of the physical gaming element that comprises a roulette ball.

18. The gaming device according to claim 15, wherein the gaming wheel is a roulette wheel.

* * * * *